US010661189B2

(12) United States Patent
Katz et al.

(10) Patent No.: US 10,661,189 B2
(45) Date of Patent: May 26, 2020

(54) BALLOON HOLDER AND BALLOON HOLDER BASE

(71) Applicant: Cary Povitz, Saint-Sauveur (CA)

(72) Inventors: Robert Katz, Montreal (CA); Sylvain Duchesne, Bromont (CA)

(73) Assignee: Cary Povitz (CA)

( * ) Notice: Subject to any disclaimer, the term of this patent is extended or adjusted under 35 U.S.C. 154(b) by 0 days.

(21) Appl. No.: 16/082,179

(22) PCT Filed: Mar. 3, 2017

(86) PCT No.: PCT/CA2017/050292
§ 371 (c)(1),
(2) Date: Sep. 4, 2018

(87) PCT Pub. No.: WO2017/147716
PCT Pub. Date: Sep. 8, 2017

(65) Prior Publication Data

US 2019/0091594 A1 Mar. 28, 2019

Related U.S. Application Data

(60) Provisional application No. 62/304,103, filed on Mar. 4, 2016, provisional application No. 62/309,703, filed
(Continued)

(51) Int. Cl.
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1041
(Continued)

(56) References Cited

U.S. PATENT DOCUMENTS 3,158,524 A * 11/1964 Tong ..... A41G 1/00 206/423
3,574,498 A * 4/1971 Zarinsky ..... F21V 35/00 248/512
(Continued)

FOREIGN PATENT DOCUMENTS

EP 0105179 A1 4/1984
WO WO-2015195981 A1 * 12/2015 ..... A47F 10/00
WO WO2015195981 A1 12/2015

OTHER PUBLICATIONS

I.S.R. and W.O. PCT /CA2017/050292.

*Primary Examiner* — Vishu K Mendiratta
(74) *Attorney, Agent, or Firm* — Lavery, De Billy, LLP; Gonzalo Lavin

(57) ABSTRACT

A balloon holder and balloon holder base for holding a balloon having a tail, including a securing element having flexible biased opposing projections bounding an elongated channel opening, an elongate member insertable into an opening in the tail of the balloon such that a first portion of said elongate member abuts a tapered self-closing bladder, creating an overlapping elongate member and balloon tail section, and a support element configured to be in contact with and support the inflated balloon, wherein the balloon is secured to the elongate member by transversely passing the overlapping elongate member and balloon tail section through the elongated channel opening and held in place by the projections.

11 Claims, 16 Drawing Sheets

Related U.S. Application Data on Mar. 17, 2016, provisional application No. 62/336, 352, filed on May 13, 2016.

(58) Field of Classification Search
USPC ..... 446/220, 222, 224
See application file for complete search history.

(56) References Cited

U.S. PATENT DOCUMENTS

| | | | | |
|---|---|---|---|---|
| 4,884,987 | A | 12/1989 | Mason | |
| 4,958,461 | A * | 9/1990 | Aldrich | A47G 7/02 47/41.01 |
| 5,087,012 | A * | 2/1992 | Doublet | G09F 17/00 211/60.1 |
| 5,509,540 | A * | 4/1996 | Pomerantz | A47F 7/0028 211/13.1 |
| 7,310,909 | B2 * | 12/2007 | Broel | A47G 7/02 248/27.8 |
| 8,069,609 | B1 * | 12/2011 | Towne | A47G 7/06 206/423 |
| 9,089,784 | B2 | 7/2015 | Nelson et al. | |
| 2008/0282608 | A1 * | 11/2008 | Lloyd | A01G 5/04 47/41.01 |
| 2013/0047502 | A1 * | 2/2013 | Wargo | A01G 5/04 47/41.13 |
| 2014/0284436 | A1 | 9/2014 | Erwin | |
| 2016/0106043 | A1 * | 4/2016 | Eiler | A01G 5/00 47/41.11 |

* cited by examiner

BALLOON HOLDER AND BALLOON HOLDER BASE

CROSS-REFERENCE TO RELATED APPLICATIONS

This application is a National Entry Application of PCT application no PCT/CA2017/050292 filed on Mar. 3, 2017 and published in English under PCT Article 21(2), which itself claims benefit of U.S. provisional application Ser. No. 62/304,103, filed on Mar. 4, 2016. All documents above are incorporated herein in their entirety by reference.

FIELD OF THE INVENTION

The present invention relates to a balloon holder and a balloon holder base. More specifically, the present invention related to a holder for novelty balloons, and a base designed to support one or more of such balloon holders.

BACKGROUND OF THE INVENTION

Novelty balloons are used for many occasions such as birthdays, get well messages, anniversaries, as well as for promotional purposes and souvenirs. Typically, these balloons are inflated using lighter than air gases, such as helium, so that they can remain in a standing or floating position. However, the cost of helium can be prohibitive and the use of helium requires a helium tank. Therefore, there exists a need for air filled balloons that can be held in an upright position.

Various types of balloon holders are well known in the art. In U.S. Pat. No. 4,798,554, Nelson et al describe a funnel-shaped balloon holder, comprising a conical cup and a hollow cylindrical stem. In EP 1 105 179, Esposito describes a closure member for a toy balloon that seals the balloon and attaches to a supporting stick. In DE 4 313 233, Hertel describes securing means for inflatable balloons comprising a bracket and a holder. In US 2009/0275260, Lockett et al describe a balloon support element comprising a concave shaped support and an attached handle. In U.S. Pat. No. 5,823,365, Page describes a ceiling-mounted balloon holder designed to retain balloons that have sticks or string-like elements attaching them to the suspended base. Finally, in U.S. Pat. No. 9,011,195, Sidwell describes a collapsible balloon support comprising a plurality of creases and supported by an air tube.

In PCT/CA2015/000467, Povitz describes a balloon holder for novelty balloons comprising a main body having a tail locking mechanism, an elongated member protruding from a bottom extremity of the main body, a support element configured to slide over the elongated member and be positioned on the main body, and a position adjustment mechanism for adjusting the position of the support element on the main body. As can be seen in FIG. 2, the securing element comprises a door having a concave gripping surface and a fastener lip. This type of fastener is often difficult to operate and is prone to breaking due to the hinged connection wearing out over time.

None of the above-mentioned inventions provide an easy to assemble balloon holder and balloon holder base that can be shipped in a compact, space saving package. Further, the prior art does not teach a balloon holder base that is made of a thin material yet is heavy enough to support multiple detachable balloon attachments.

SUMMARY OF THE INVENTION

According to the present invention, there is provided a balloon holder for holding a balloon having a tail, comprising a securing element having flexible biased opposing projections bounding an elongated channel opening, an elongate member insertable into an opening in the tail of the balloon such that a first portion of said elongate member abuts a tapered self-closing bladder, creating an overlapping elongate member and balloon tail section, and a support element configured to be in contact with and support the inflated balloon, wherein the balloon is secured to the elongate member by transversely passing the overlapping elongate member and balloon tail section through the elongated channel opening and held in place by the projections.

There is also provided a balloon holder base for holding a plurality of balloon holders each comprising an elongate member, comprising a main body having a top surface with a plurality of openings allowing access to a plurality of corresponding holding cavities, the holding cavities having inclined portions defining therebetween an opening, wherein each elongate member of the plurality of balloon holders is insertable into an associated one of the plurality of the holding cavities, each elongate member laying against the inclined portion of the associated holding cavity, each elongate member held in place by a lever force applied to each elongate member by the inclined portions of the associated holding cavity.

Similar references used in different Figures denote similar components.

DETAILED DESCRIPTION OF THE ILLUSTRATIVE EMBODIMENTS

Figure 1:
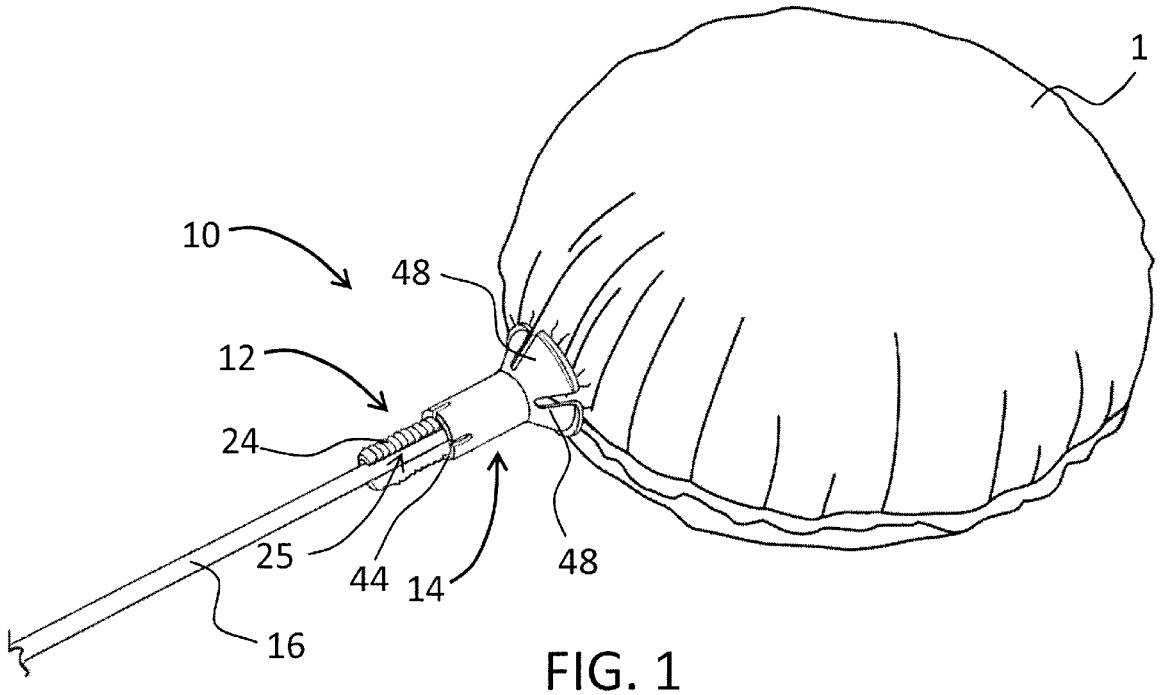
FIG. 1 is a perspective view of a balloon holder, in accordance with an illustrative embodiment of the present invention.

Referring to FIG. 1, there is shown a balloon holder, generally referred to using the reference numeral 10, which consists of a securing element 12, having a support element 14 slidingly engaged thereon and an elongate member 16. The elongate member 16 may be provided with a hollow core along its full length so as to allow the inflating of a balloon 1. The securing element 12 secures the balloon 1 to the elongate member 16, and the support element 14 maintains the balloon 1 in an upright position without the need for the balloon 1 to be filled with a lighter than air gas, for example helium, while still giving the impression that the balloon 1 is floating. The various components of the balloon holder 10 may be made, for example, of materials such as polypropylene, plastic and other such light polymeric materials.

Figure 2:
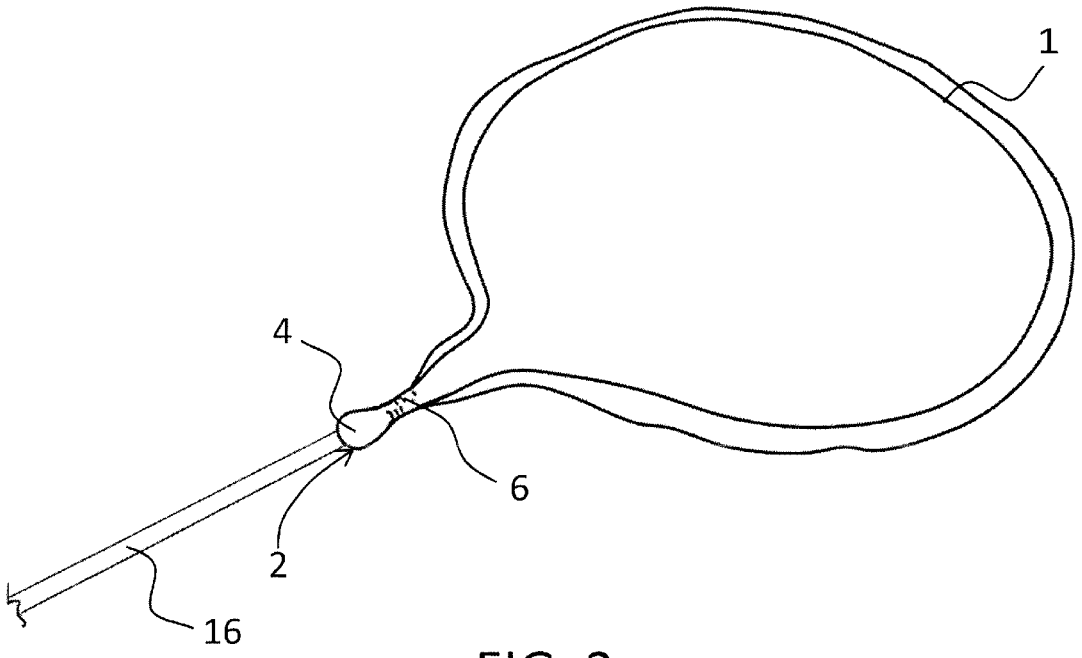
FIG. 2 is a perspective view of an elongate member inserted into an un-inflated balloon, in accordance with an illustrative embodiment of the present invention.
Figure 3:
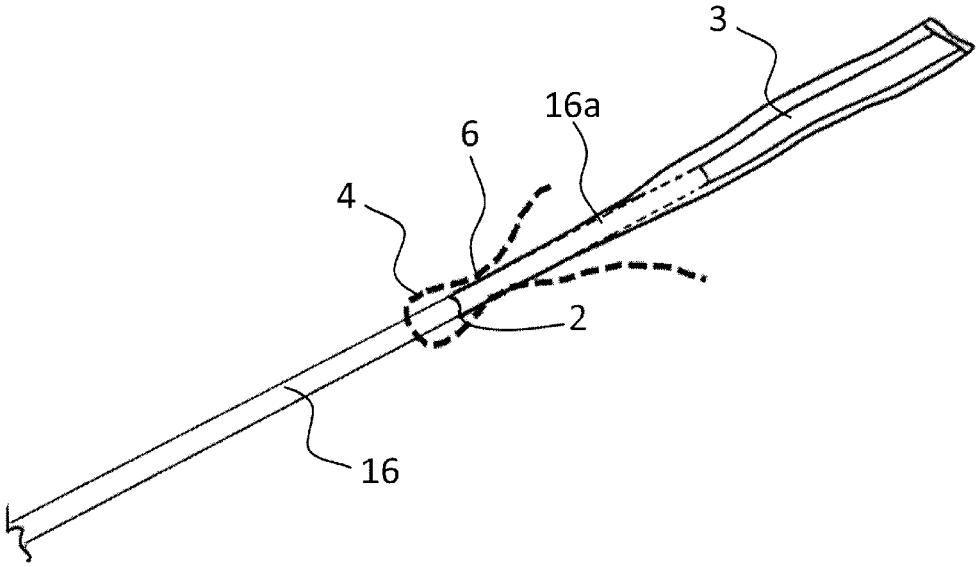
FIG. 3 is a perspective view of an elongate member inserted into a tapered self-closing balloon, in accordance with an illustrative embodiment of the present invention.

Referring to FIGS. 2 and 3, the elongate member 16 is inserted into the opening 2 of the balloon 1 such that a first portion 16*a* of the elongate member 16 abuts the tapered self-closing bladder 3 of the balloon 1. An overlapping section of the balloon tail 6 overlaps the first portion 16*a* of the elongate member 16. In an alternative embodiment, the balloon 1 may not include a self-closing bladder 3, in which case the first portion 16*a* of the elongate member 16 may be provided with one, both being inserted into the balloon opening 2 and then bonded to section 6 of the balloon tail.

Figure 4:
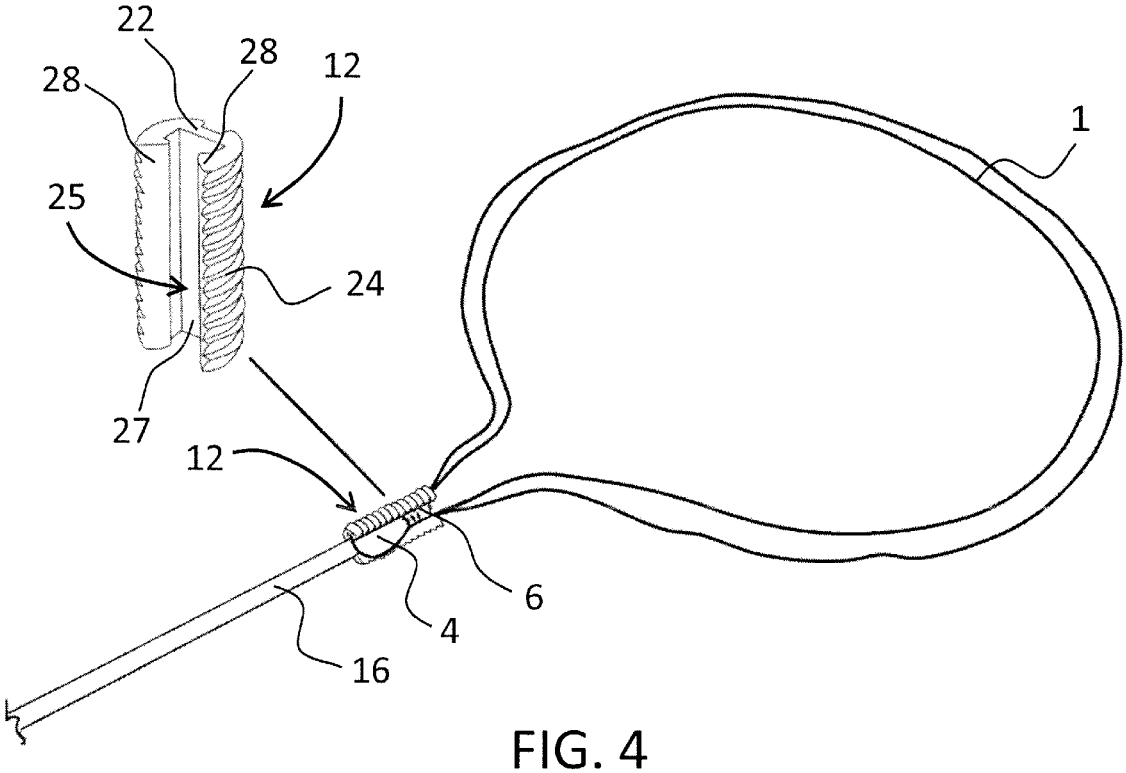
FIG. 4 is a perspective view of a securing element securing an uninflated balloon to an elongate member, as well as a perspective view of a securing element, in accordance with an illustrative embodiment of the present invention.

Referring now to FIG. 4, the securing element 12 is positioned on the overlapping section of the balloon tail 6 so as to secure the balloon 1 to the elongate member 16. To this end, the securing element 12 includes a main body 22 having a teethed portion 24, a back wall 27 and flexible biased opposing flanges, fingers, retainers or projections 28 bounding an elongated channel opening 25 through which the elongate member 16 and overlapping section of the balloon tail 6 may transversely pass therethrough and be held in place by flanges 28. In an alternative embodiment, the portion of the securing element 12 that will come into contact with the elongate member 16 contains an adhesive, such as glue, in order to further strengthen the connection. It is to be understood that securing element 12 comprises no moving parts and is therefore more durable and easier to operate than previously disclosed solutions.

Figure 5:
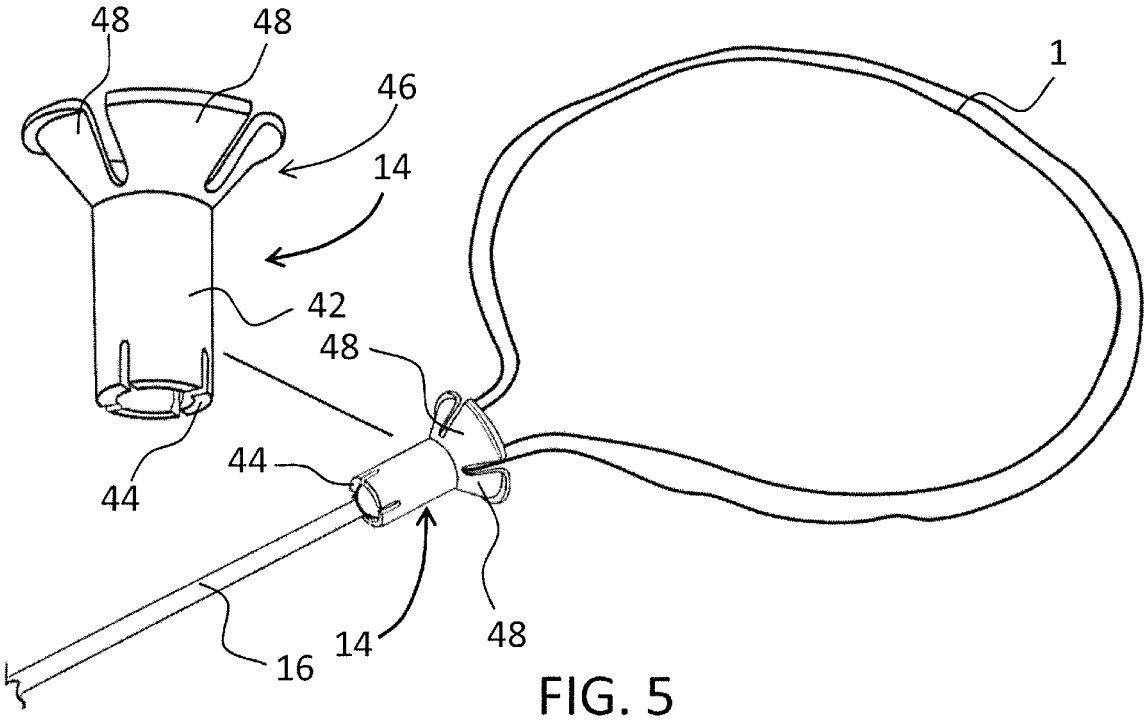
FIG. 5 is a perspective view of a support element engaging the securing element of FIG. 4, as well as a perspective view of a support element, in accordance with an illustrative embodiment of the present invention.
Figure 6:
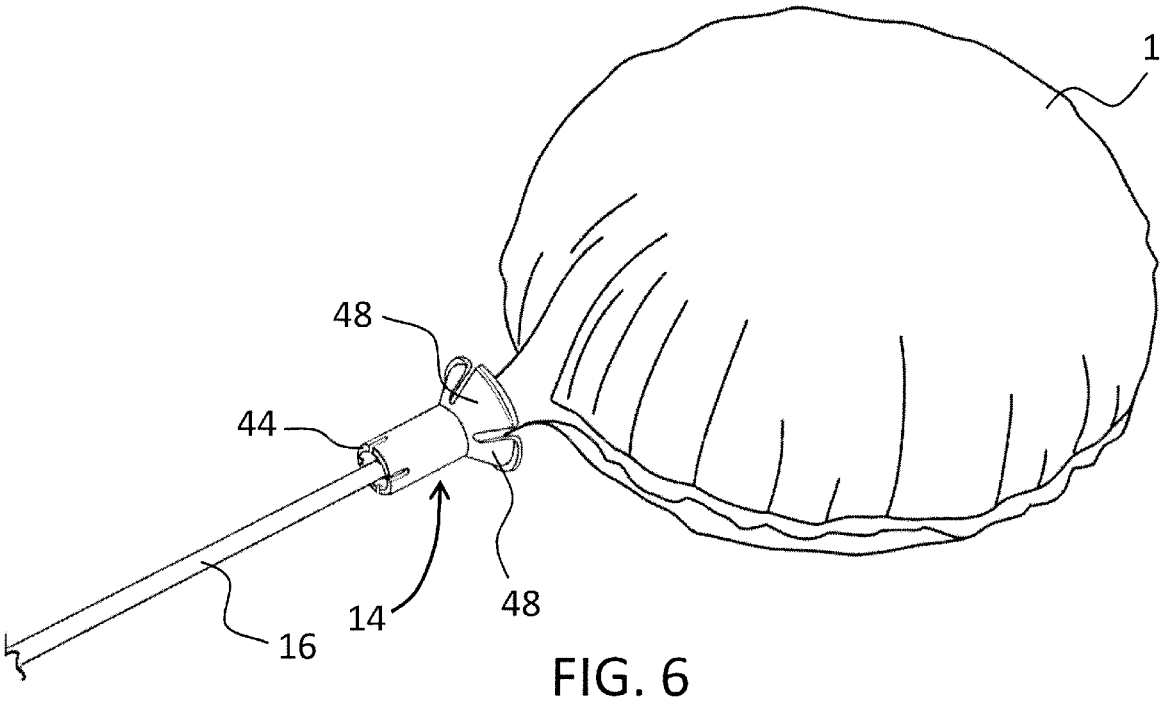
FIG. 6 is a perspective view of a support element engaging a securing element and an inflated balloon, in accordance with an illustrative embodiment of the present invention.

Referring to FIGS. 5 and 6, the support element 14 includes a main body 42 having a plurality of ratchets 44 at one end and a basket 46 at an opposed end, the basket 46 having one or more support members 48 configured to be in contact with and support the balloon 1 once inflated. The support members 48 may be flexible so as to accommodate various sizes and shapes of balloons 1 as well as to provide greater mobility for the balloon 1 while still holding it firmly. Although the basket 46 is shown as being circular, it is to be understood that its shape may vary in order to accommodate various shapes of balloons 1. For example, in an alternative embodiment the basket 46 may be oval in shape.

Referring back to FIG. 1, once the securing element 12 is secured to the elongate member 16 and the overlapping section of the balloon tail 6, the support element 14 is slid over the elongate member 16 until it slides over the securing element 12 and its ratchets 44 engage the teethed portion 24 of the securing element 12. The position of the support element 14 onto the securing element 12 can be adjusted by the positioning of the ratchets 44 with regard to the teethed portion 24 to accommodate various configurations of balloons 1. It is to be understood that in an alternative embodiment the positioning of the support element 14 onto the securing element 12 may be performed using another adjustment mechanism.

Figure 7:
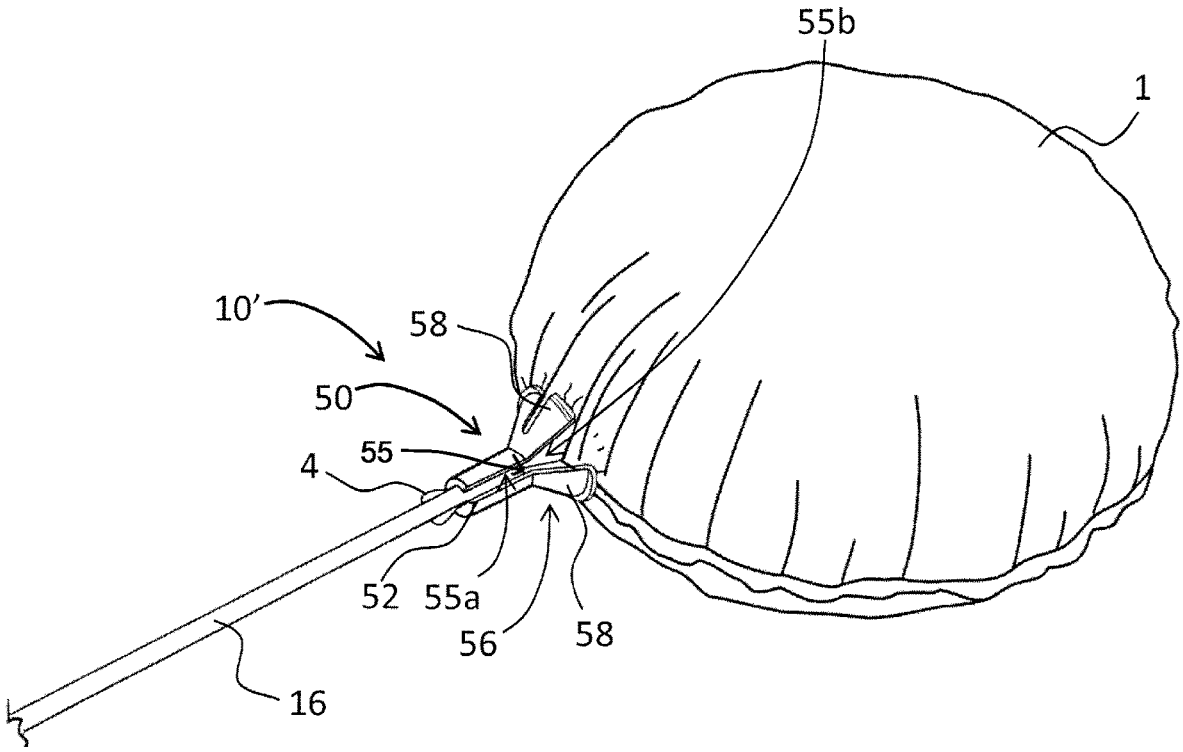
FIG. 7 is a perspective view of a balloon holder, in accordance with an illustrative embodiment of the present invention.
Figure 8:
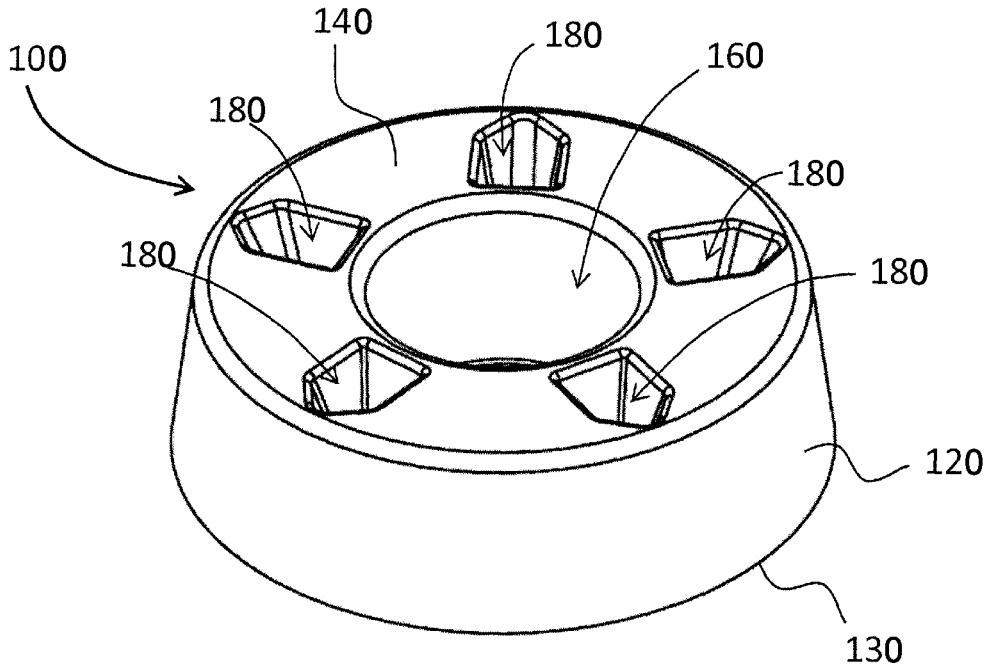
FIG. 8 is a top perspective view of a balloon holder base, in accordance with an illustrative embodiment of the present invention.

Referring now to FIG. 7, there is shown a balloon holder 10', in accordance with an alternative illustrative embodiment of the present disclosure, generally consisting of a one pieced securing and support element 50 comprising a main body 52, a basket 56 having a plurality of support members 58 and an elongated channel opening 55 having a main body 55*a* and basket 55*b* portions. The main body 52 includes the features of the above mentioned securing element 12 of the balloon holder 10 of the previous embodiment, namely the generally flat back wall (not shown) and flexible biased opposing flanges (not shown) bounding the main body elongated channel opening portion 55*a*, with the with the exception of the teethed portion as the positioning of the basket 56 is fixed and not adjustable. The elongated channel opening portion 55*b*, along with the main body 30 elongated channel opening portion 55*a*, allows the securing of the support element 50 onto the elongate member 16 by transversely pass therethrough the latter to be held in place by the main body flanges (not shown).

Referring now to FIGS. 6 and 7, the balloon 1 can be inflated by pumping air through the hollow core of the elongate member 16. The hollow core of the elongate member 16 further allows for the insertion of a tube (not shown) having a diameter less than that of the tapered self-closing bladder 3 of the balloon 1 so that the tube may be inserted through the tapered self-closing bladder 3 and into the balloon 1 in order to deflate it.

Figure 9:
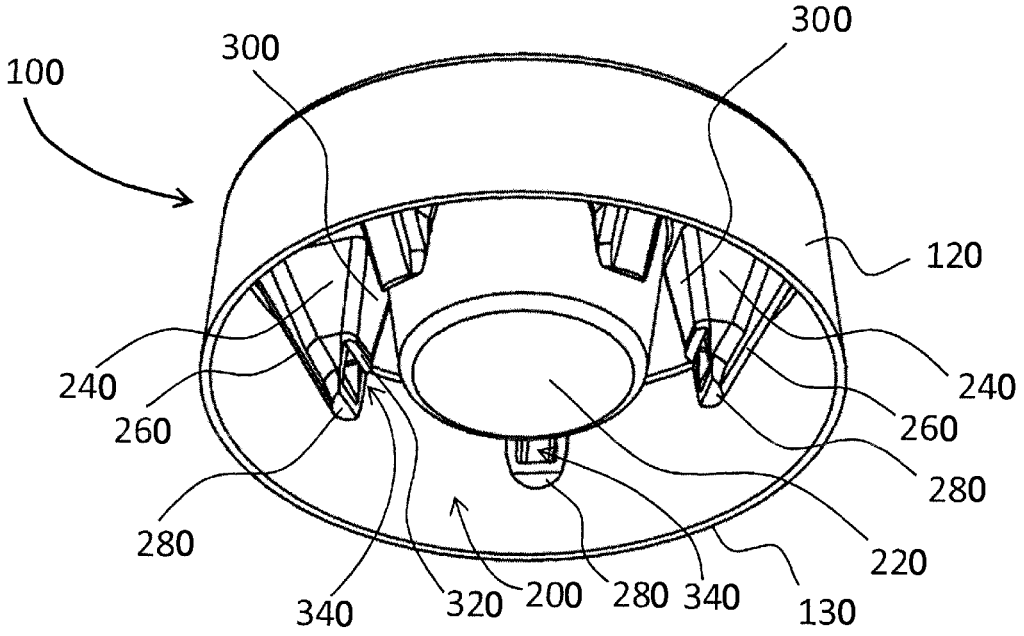
FIG. 9 is a bottom perspective view of a balloon holder base, in accordance with an illustrative embodiment of the present invention.
Figure 10:
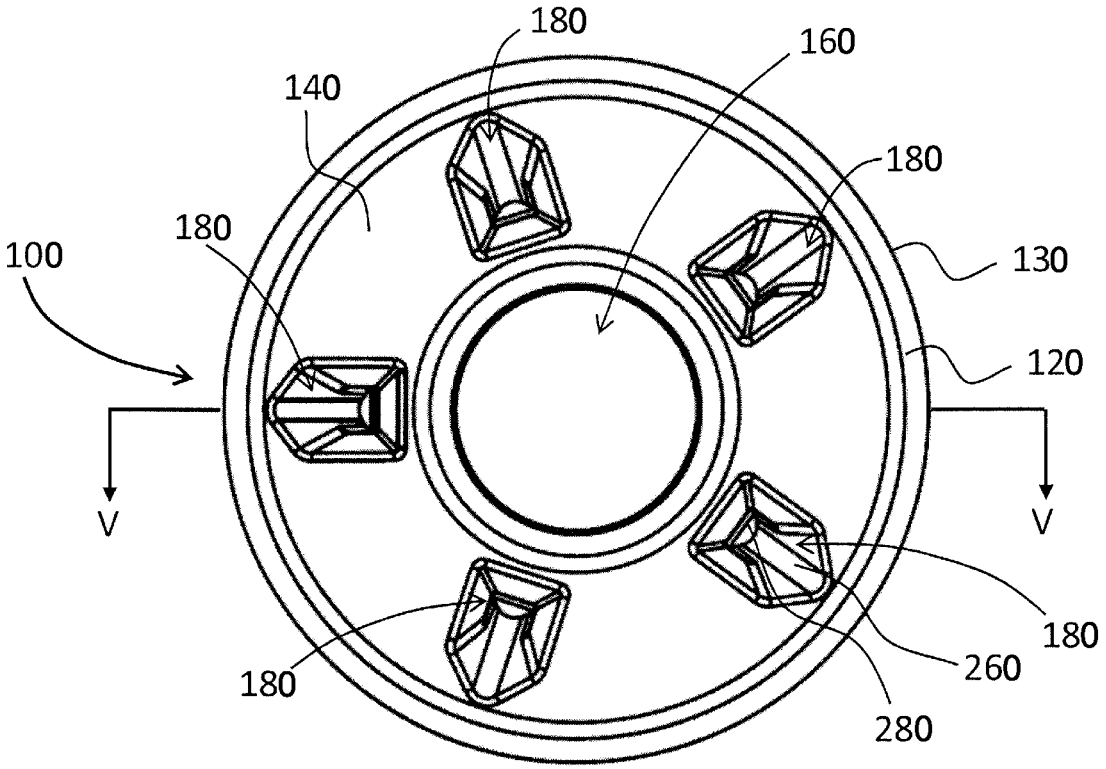
FIG. 10 is a top view of a balloon holder base, in accordance with an illustrative embodiment of the present invention.
Figure 11:
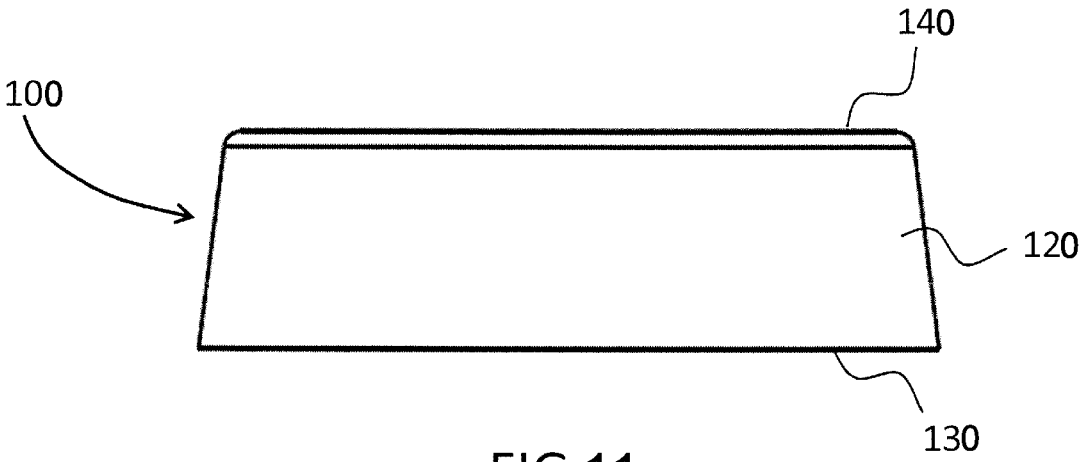
FIG. 11 is a side view of a balloon holder base, in accordance with an illustrative embodiment of the present invention.

Referring to FIGS. 8 to 11, a balloon holder base 100 generally consists of a main body 120 having a top surface 140 with a plurality of openings allowing access to a main cavity 160, holding cavities 180, and optionally a central cavity (not shown). With particular reference to FIG. 9, the main cavity 160 has a bottom surface 220 that is either level with a bottom perimeter 130 of the main body 120 or off level by a distance equivalent to the thickness of an adhesive film to allow the securing of the balloon holder base 100 to a surface, for example a table or counter. Each of the holding cavities 180 is formed by side walls 240, an inclined outer wall 260 biased away from the bottom perimeter 130 of the main body 120, the side walls 240 and inclined outer walls 260 terminating at a bottom end with lower stopper surface 280, and a partial inner wall 300 terminating at a bottom end with upper stopper surface 320. The lower stopper surface 280 and upper stopper surface 320 are offset so as to create an opening 340 therebetween and the side walls 240.

Still referring to FIGS. 8 to 11, the shapes of the main body cavity 120 and cavities 160, 180 are such as to allow the staking of a plurality of balloon holder bases 100 in a space saving configuration, the balloon holder bases 100 nesting one within the other. Furthermore, the shapes of the main body 120 and cavities 160, 180 allow mass production of the balloon holder base 100 using an injection molding process, which requires a design such that the balloon holder base 100 can be created using a pair of plates pressed together during the molding process and subsequently separated to remove the molded base 100, i.e. injection mold and ejector mold plates.

Figure 12:
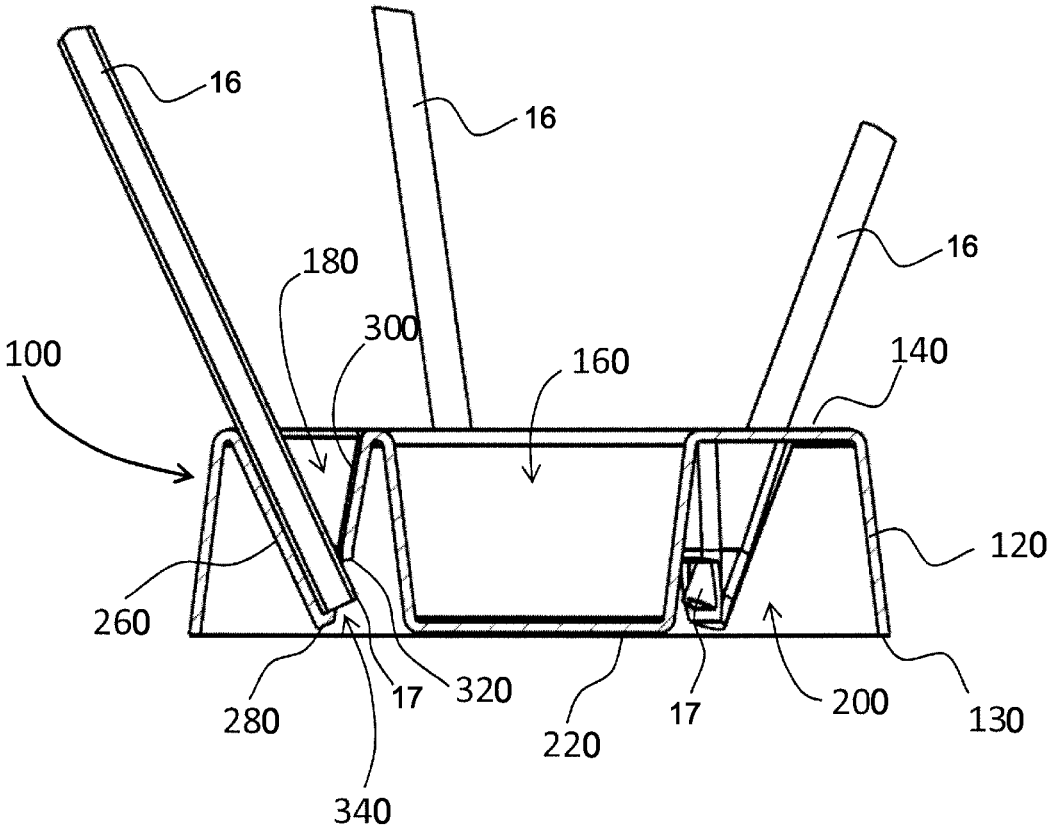
FIG. 12 is a cross-sectional side view of a balloon holder base supporting a plurality of balloon holders taken along axis V-V of FIG. 10, in accordance with an illustrative embodiment of the present invention.
Figure 13:
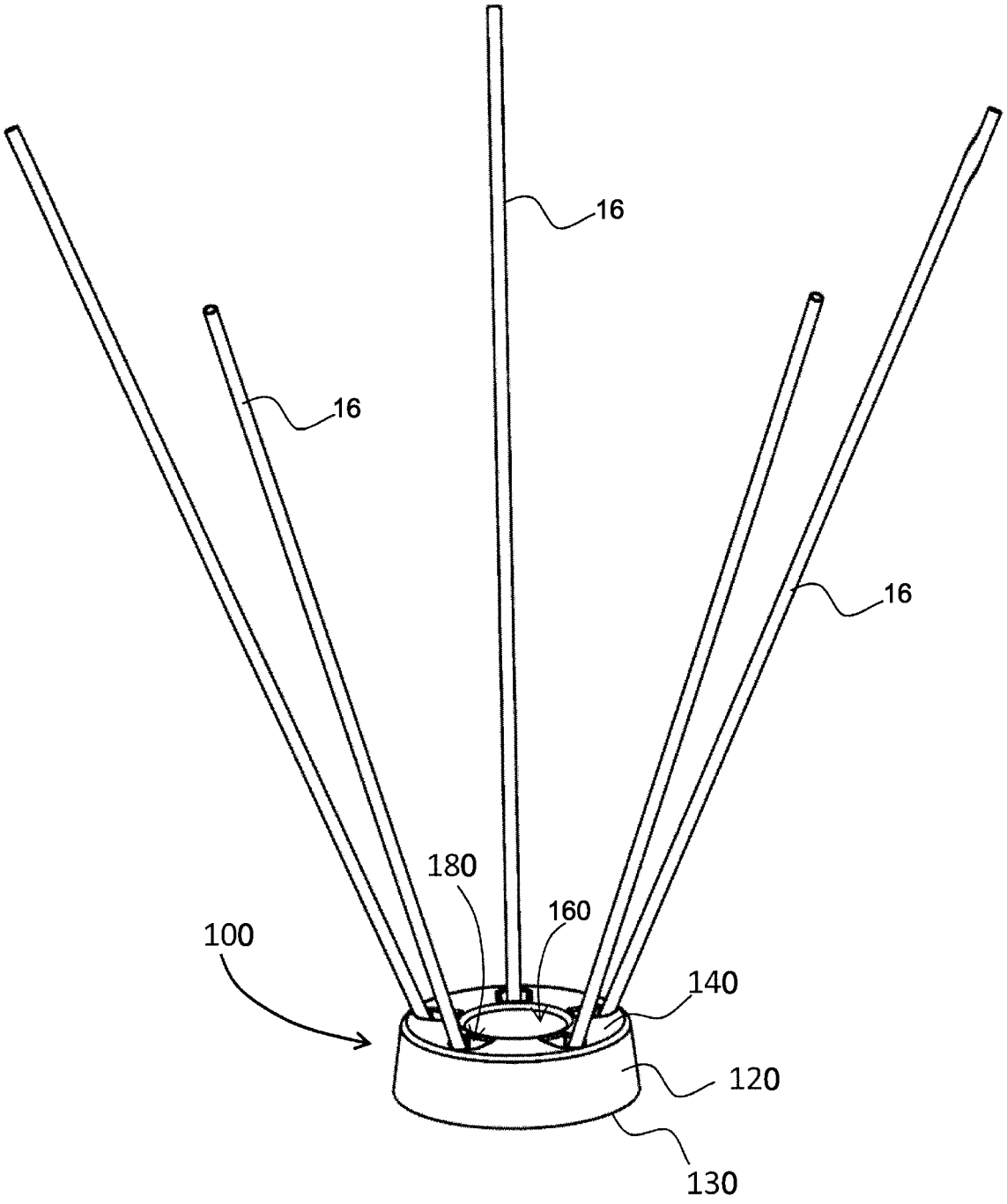
FIG. 13 is a top perspective view of a balloon holder base supporting a plurality of balloon holders, in accordance with an illustrative embodiment of the present invention.
Figure 14:
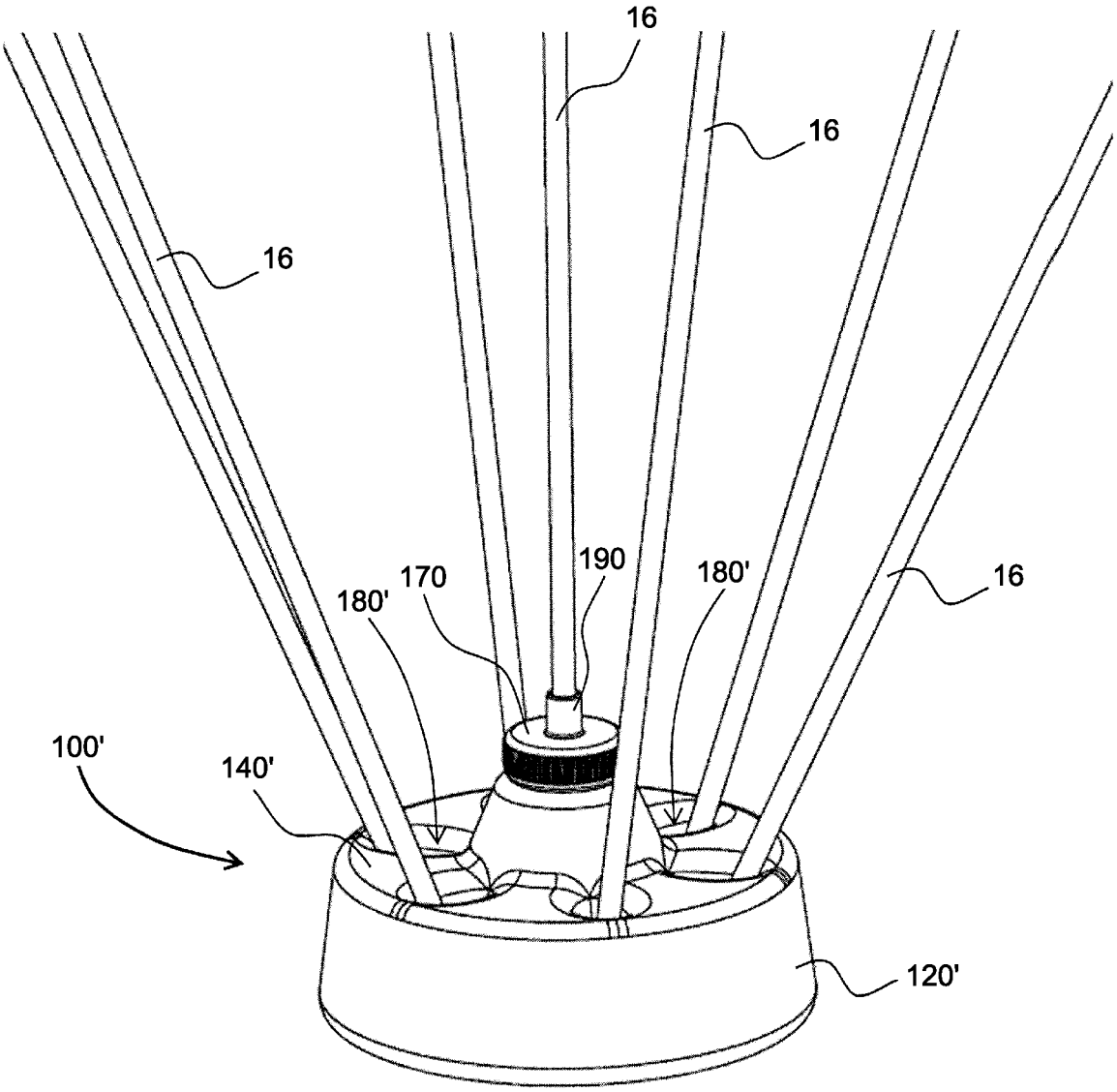
FIG. 14 is a top perspective view of a balloon holder base supporting a plurality of balloon holders, in accordance with an illustrative embodiment of the present invention.
Figure 15:
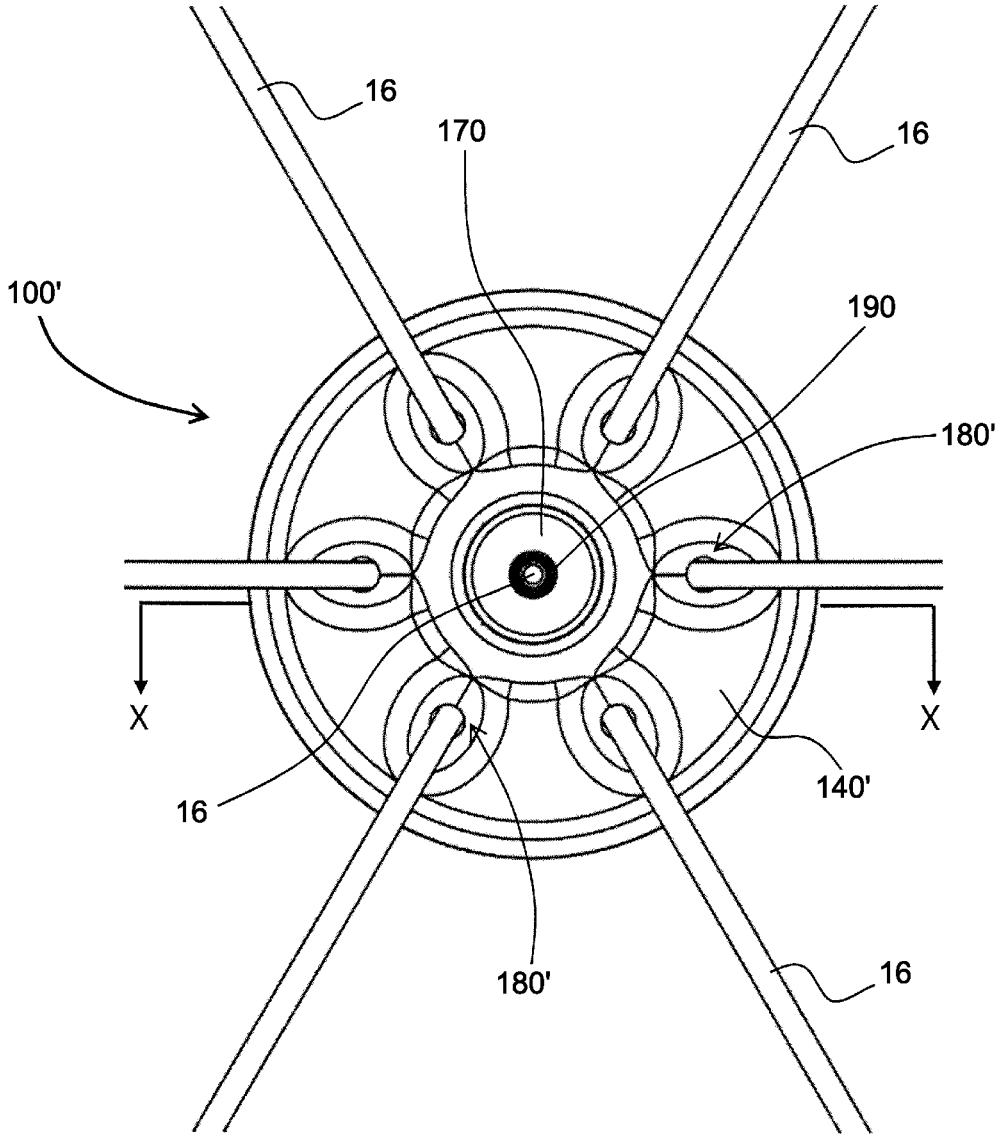
FIG. 15 is a top view of a balloon holder base supporting a plurality of balloon holders, in accordance with an illustrative embodiment of the present invention.
Figure 16:
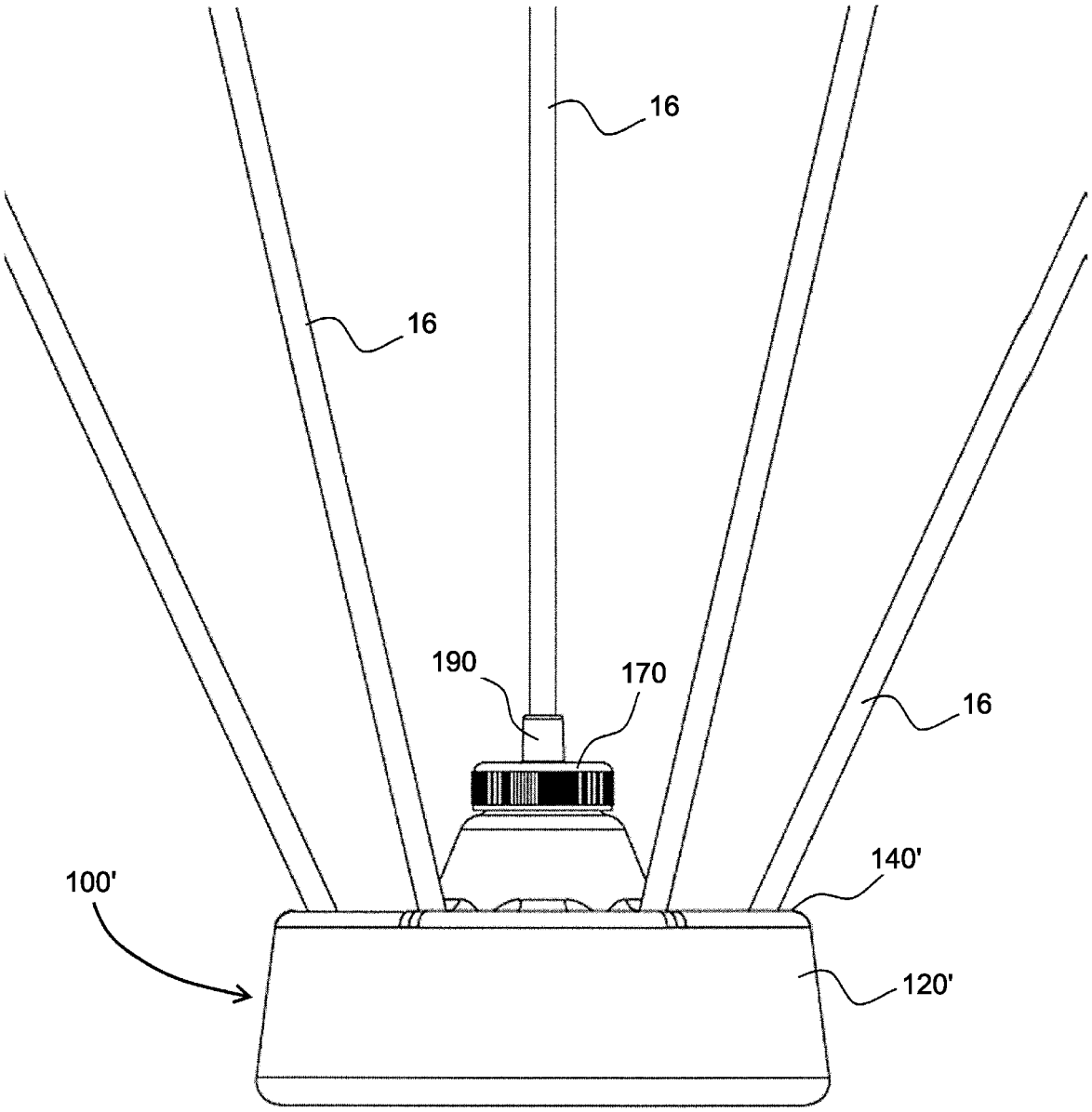
FIG. 16 is a side view of a balloon holder base supporting a plurality of balloon holders, in accordance with an illustrative embodiment of the present invention.
Figure 17:
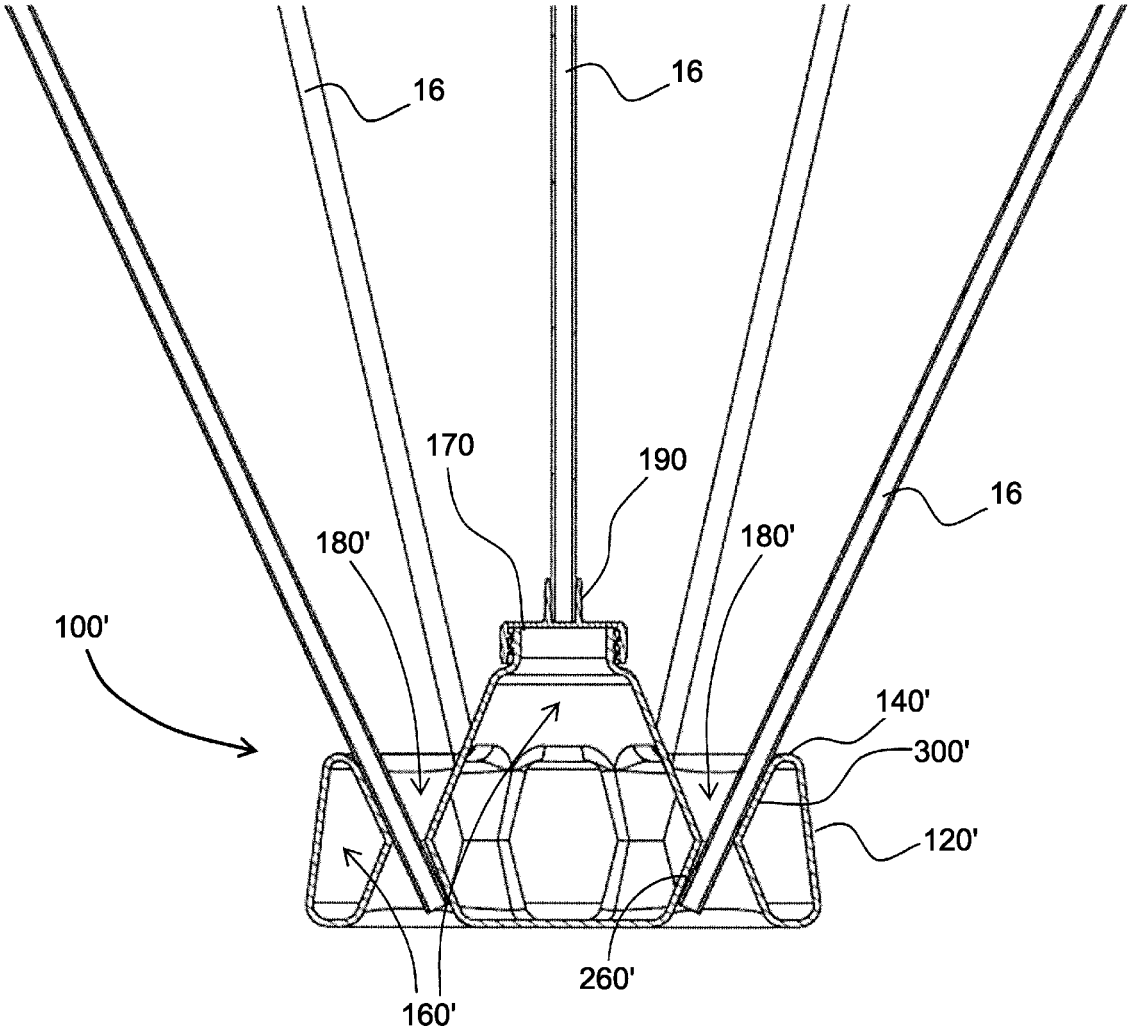
FIG. 17 is a cross-sectional side view of a balloon holder base supporting a plurality of balloon holders taken along axis X-X of FIG. 15, in accordance with an illustrative embodiment of the present invention.
Figure 18:
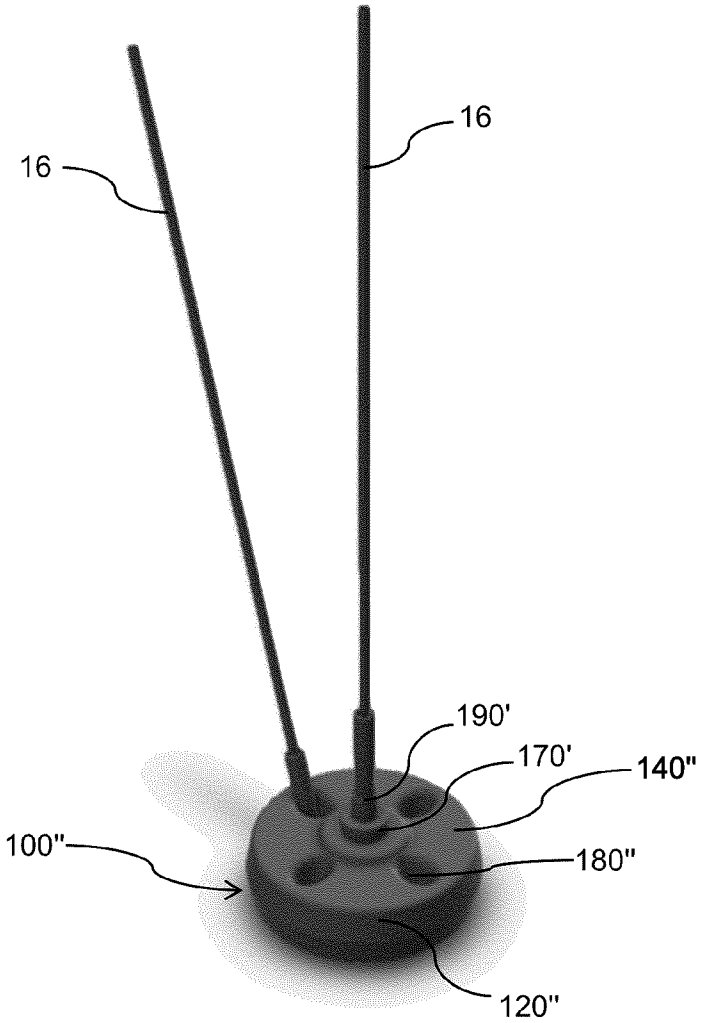
FIG. 18 is a top perspective view of a balloon holder base supporting a plurality of balloon holders, in accordance with an illustrative embodiment of the present invention.
Figure 19:
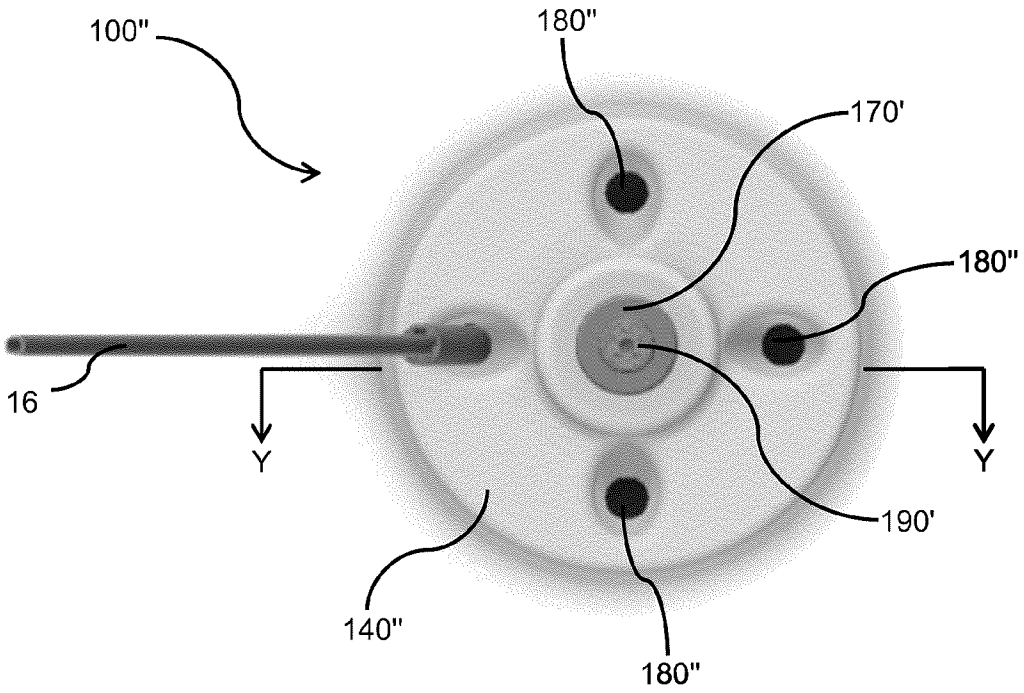
FIG. 19 is a top view of a balloon holder base supporting a plurality of balloon holders, in accordance with an illustrative embodiment of the present invention.
Figure 20:
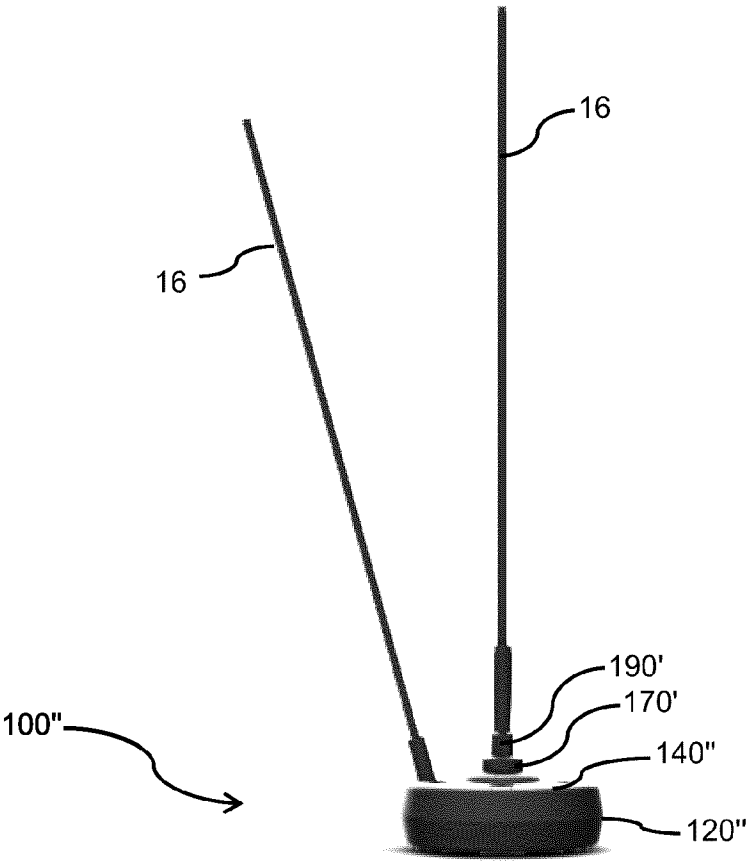
FIG. 20 is a side view of a balloon holder base supporting a plurality of balloon holders, in accordance with an illustrative embodiment of the present invention.
Figure 21:
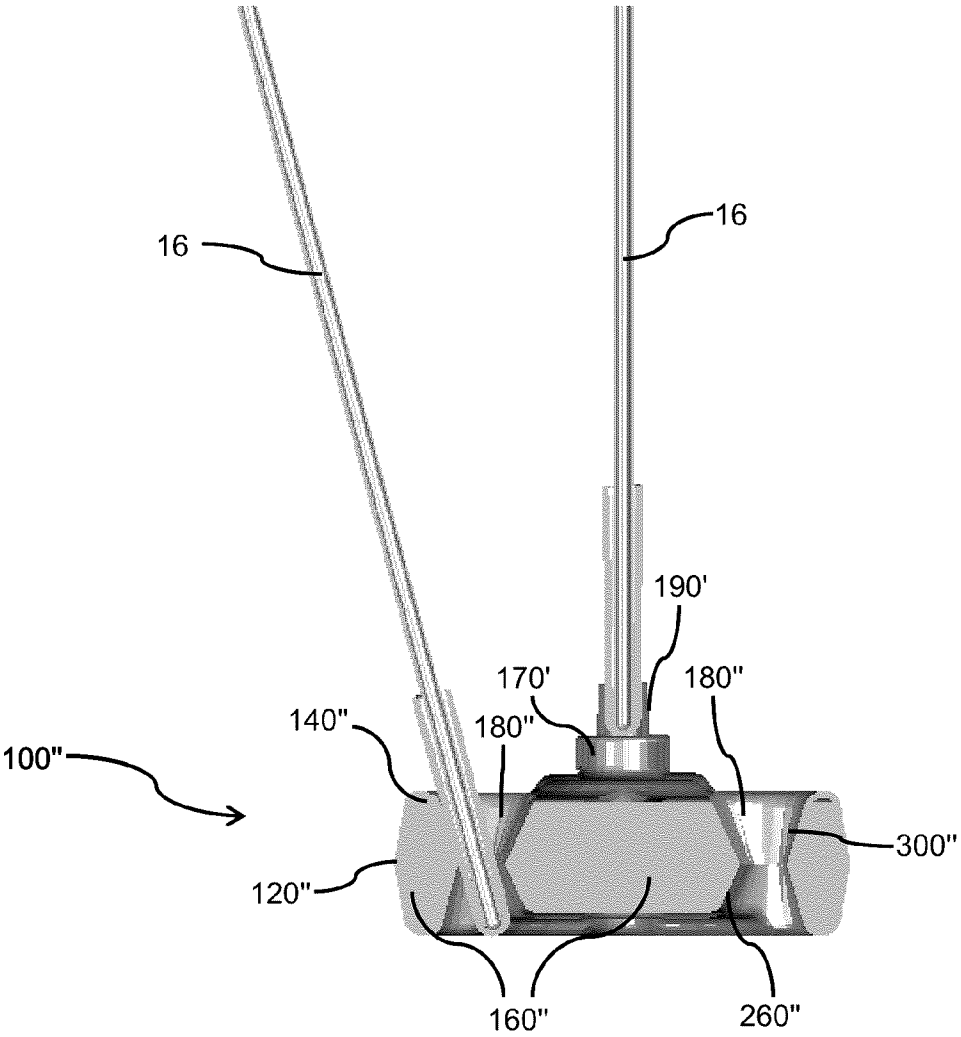
FIG. 21 is a cross-sectional side view of a balloon holder base supporting a plurality of balloon holders taken along axis Y-Y of FIG. 19, in accordance with an illustrative embodiment of the present invention.

Referring now to FIGS. 12 and 13, the elongate member 16 of each balloon holder 10 is inserted into a respective holding cavity 180. When fully inserted into a holding cavity 180, each elongate member 16 lays against the inclined outer wall 260 of a respective holding cavity 180 with the bottom end 17 of each elongate member 16 resting against the lower stopper surface 280 of each holding cavity 180 while part of it passes through opening 340. The elongate member 16 is held in place by a lever force pushing the part of the bottom end 17 passing through opening 340 against an upper stopper surface 320. Accordingly, each elongate member 16 can be easily inserted into and removed from the balloon holder base 100. Corresponding inclined outer walls 260 and partial inner walls 300 form an obtuse angle with one another, for example 120 degrees, so as to permit each elongate member 16 to abut against one of the walls 260, 300.

Referring now to FIGS. 14 to 17, a balloon holder base 100' in accordance with an alternative illustrative embodiment of the present invention generally consists of a main body 120' having a top surface 140' with a plurality openings allowing access to a plurality of holding cavities 180'. A removable cap 170, provided with an elongate member holder 190 for holding an elongate member 16 positioned thereon, allows access to a main cavity 160' defined within the main body 120' for filling with a substance, such as water or another liquid, sand or another such particle, to stabilize the balloon holder base 100' when resting on a surface, for example a table or counter. Each holding cavity 180' comprises an inclined outer wall 260' and an opposed inner wall 300'.

Still referring to FIGS. 14 to 17, each elongate member 16 is to be inserted into a respective holding cavity 180' or the cap holder 190. When fully inserted into a holding cavity 180', the elongate member 16 lays against the inclined outer wall 260' and inner wall 300' of the cavity 180' and is self-centeringly held in place by a lever force applied to the elongate member 16. Accordingly, each elongate member 16 can be easily inserted into and removed from the balloon holder base 100'. Corresponding inclined outer walls 260' and partial inner walls 300' form an obtuse angle with one another, for example 120 degrees, so as to permit each elongate member 16 to abut against one of the walls 260', 300'.

Referring now to FIGS. 18 to 21, a balloon holder base 100" in accordance with an alternative illustrative embodiment of the present invention generally consists of a main body 120" having a top surface 140" with a plurality openings allowing access to a plurality of holding cavities 180". Balloon holder 100" may be manufactured using a blow molding process to achieve a more rounded shape and to strike an advantageous balance between thickness and weight. A removable cap 170', provided with an elongate member holder 190' for holding an elongate member 16 positioned thereon, allows access to a main cavity 160" defined within the main body 120" for filling with a substance, such as water or another liquid, sand or another such particle, to stabilize the balloon holder base 100" when resting on a surface, for example a table or counter. Each holding cavity 180" comprises an inclined outer wall 260" and an opposed inner wall 300".

Still referring to FIGS. 18 to 21, each elongate member 16 is to be inserted into a respective holding cavity 180" or the cap holder 190'. When fully inserted into a holding cavity 180", the elongate member 16 lays against the inclined outer wall 260" and inner wall 300" of the cavity 180" and is self-centeringly held in place by a lever force applied to the elongate member 16. Accordingly, each elongate member 16 can be easily inserted into and removed from the balloon holder base 100". Corresponding inclined outer walls 260" and partial inner walls 300" form an obtuse angle with one another, for example 120 degrees, so as to permit each elongate member 16 to abut against one of the walls 260", 300".

It is to be understood that in alternative embodiments, the shape of the main body 120, 120', 120" may vary. For example, the main body 120, 120', 120" may be rectangular shaped or star shaped. In another alternative embodiment, the main cavity 160, 160', 160" may be absent or be replaced by a plurality of cavities (not shown), and further the depth of the one or more cavities 160, 160', 160" may vary as well. In a further alternative embodiment, the number of and/or disposition of the holding cavities 180, 180', 180" may also vary. For example, the holding cavities 180, 180', 180" may be disposed in either regular or irregular patterns, or may be disposed in multiple rows. In a further alternative embodiment, the side wall 240, 240', inclined outer wall 260, 260', 260" and partial inner wall 300, 300', 300" may be unitary and form a conical shape.

The scope of the claims should not be limited by the preferred embodiments set forth in the examples, but should be given the broadest interpretation consistent with the description as a whole.

The invention claimed is:

1. A balloon holder (10) for holding a balloon (1) having a tail, comprising:

a securing element (12) comprising a main body (22) comprising a teethed portion (24), a back wall (27) and a plurality of flexible biased opposing projections (28) bounding an elongated channel opening (25);

an elongate member (16) insertable into an opening (2) in the tail of the balloon (1) such that a first portion of said elongate member (16) abuts a tapered self-closing bladder (3), creating an overlapping elongate member and balloon tail section (6); and a support element (14) comprising a main body (42) comprising a plurality of ratchets (44) at one end and a basket (46) at another end, said basket (46) comprising at least one support member (48), said at least one support element configured to be in contact with and support the balloon (1) once inflated, said plurality of ratchets (44) configured to engage with said teethed portion (24) of said securing element (12);

wherein the balloon (1) is secured to said elongate member (16) by transversely passing said overlapping elongate member and balloon tail section (6) through said elongated channel opening and held in place by said projections (28);

wherein said securing element (12) is slideable over said elongate member (16); and wherein said plurality of ratchets (44) are configured to engage with said teethed portion (24) of said securing element (12) to secure and adjust the position of said support element (14) with said securing element (12).

2. The balloon holder of claim 1, wherein the balloon (1) comprises said tapered self-closing bladder (3).

3. The balloon holder of claim 1, wherein the elongate member (16) comprises said tapered self-closing bladder (3).

4. The balloon holder claim 1, wherein said elongate member (16) is hollow.

5. The balloon holder of claim 1, wherein said projections (28) comprise at least one of flanges, fingers and retainers.

6. A balloon holder base (100) for holding a plurality of balloon holders (10) each comprising an elongate member (16), comprising:

a main body (120) having a top surface (140) and a bottom perimeter (130), said top surface comprising a plurality of corresponding holding cavities (180), each said holding cavity (180) formed by a plurality of side walls (240), an inclined outer wall (260) biased away from said bottom perimeter (130), said side walls (240) and said inclined outer wall (260) terminating at a lower stopping surface (280) at a bottom end of each said holding cavity (180), and a partial inner wall (300) terminating at an upper stopping surface (320) offset from said lower stopping surface (280) defining therebetween an opening (340) towards said bottom end of each said holding cavity (180);

wherein each elongate member (16) of the plurality of balloon holders (10) is insertable into an associated one of the plurality of said holding cavities (180) such that each elongate member (16) lays against said inclined outer wall (260) of said associated holding cavity (180) and a bottom end (17) of each elongate member (16) rests against said lower stopping surface (280), each elongate member (16) partially passing through said opening (340) towards said bottom end of each said holding cavity (180) such that each elongate member (16) is held in place by a lever force pushing said bottom end (17) of each elongate member (16) against said upper stopping surface (320).

7. The balloon holder base of claim 6, wherein said main body (120) further comprises a central cavity and a main cavity (160), said central cavity comprising a bottom surface (220) off-level with a bottom perimeter (130) of said main cavity (160) by a distance equivalent to the thickness of an adhesive film securing the balloon holder base (100) to a surface.

8. The balloon holder base of claim 6, wherein said main body (120) and said cavities (160, 180) are shaped such that a plurality of balloon holder bases (100) are stackable and nestable.

9. The balloon holder base of claim 6, wherein the balloon holder base (100) is mass produceable by injection molding process.

10. The balloon holder base of claim 6, wherein the balloon holder base (100) is mass produceable by blow molding process.

11. The balloon holder base of claim 6, wherein said main body (120) further comprises a main cavity (160) fillable with one of a liquid and particles to stabilize the balloon holder base (100) when resting on a surface, and further comprises a removable cap (170) allowing access to said main cavity (160).

* * * * *